US006572052B1

(12) United States Patent
Hansen

(10) Patent No.: US 6,572,052 B1
(45) Date of Patent: Jun. 3, 2003

(54) PROCESS AND DEVICE FOR DETERMINING ROLL ANGLE

(75) Inventor: Ake Hansen, Karlstad (SE)

(73) Assignee: Saab AB, Linköping (SE)

( * ) Notice: Subject to any disclaimer, the term of this patent is extended or adjusted under 35 U.S.C. 154(b) by 0 days.

(21) Appl. No.: 09/830,254

(22) PCT Filed: Oct. 6, 1999

(86) PCT No.: PCT/SE99/01777

§ 371 (c)(1),
(2), (4) Date: Jun. 6, 2001

(87) PCT Pub. No.: WO00/26602

PCT Pub. Date: May 11, 2000

(30) Foreign Application Priority Data

Oct. 29, 1998 (SE) ..... 9803706

(51) Int. Cl.[7] ..... F41G 7/28
(52) U.S. Cl. ..... 244/3.11; 244/3.14
(58) Field of Search ..... 244/3.11, 3.13, 244/3.14, 3.21; 89/6.5

(56) References Cited

U.S. PATENT DOCUMENTS 4,641,801 A * 2/1987 Lynch et al. ..... 244/3.11
4,967,981 A * 11/1990 Yff ..... 244/3.14
5,099,246 A * 3/1992 Skagerlund ..... 244/3.14
5,163,637 A 11/1992 Hansen
5,233,901 A * 8/1993 Nilsson et al. ..... 73/167
5,414,430 A 5/1995 Hansen
5,661,555 A * 8/1997 Romer et al. ..... 244/3.13

FOREIGN PATENT DOCUMENTS

EP 0319649 7/1988

* cited by examiner

*Primary Examiner*—Peter M. Poon
*Assistant Examiner*—Timothy D. Collins
(74) *Attorney, Agent, or Firm*—Swidler Berlin Shereff Friedman, LLP

(57) ABSTRACT

A process for determining roll angle of a body launchable from a launcher. At least one inducing field is induced in the launchable body. A polarized carrier wave is transmitted from the launcher to the launchable body. The transmitted polarized carrier wave is detected in the launchable body with respect to rotation of the launchable body. The detected transmitted polarized carrier wave and the inducing field are analyzed to establish the roll angle as the launchable body leaves the launcher.

2 Claims, 3 Drawing Sheets

PROCESS AND DEVICE FOR DETERMINING ROLL ANGLE

FIELD OF THE INVENTION

The present invention relates to a process for determining the roll angle in a launchable body, such as a rotary projectile, shell, missile, etc., which is launchable from a launcher, induced fields being used to establish the roll angle of the launchable body as it leaves the launcher by at least one inducing field being generated in the launcher and the inducing field or fields being detected in the launchable body. The invention also relates to a device for determining the roll angle in a launchable body, such as a rotary projectile, shell, missile, etc., which is launchable from a launching tube forming part of a launcher, which device comprises magnetic-field-generating members and magnetic-field-detecting members for establishing the roll angle of the launchable body when the body leaves the launching tube of the launcher, the magnetic-field-generating members being arranged in connection with the launching tube and the magnetic-field-detecting members being housed in the launchable body.

The invention is applicable to all types of projectiles, missiles, etc. which are launched from a firing tube or launching tube and which rotate in their trajectory. More specifically, the invention can be used with so-called final-phase-guided ammunition, i.e. projectiles which are conventionally fired in a ballistic trajectory to the immediate vicinity of the target where they receive a command for necessary correction. Because of the fact that the projectile rotates in its trajectory, its roll position has to be determined when the command is executed. In the absence of roll-position-determining members, an error otherwise occurs in the course correction.

BACKGROUND OF THE INVENTION

A device for determining the roll angle in a launchable body is previously known by virtue of EP, A1, 0 319 649. An induced field is used to establish the roll angle of the launchable body as it leaves the launcher. The induced field is generated in the launcher and detected in the launchable body. At the moment of launch, the roll angle determined in the launchable body is considered to have acceptable precision. Since no monitoring is made of the rotational velocity of the rotatable body after the moment of launch, the rotatable body does however risk the imminent introduction of unacceptable deviation into the roll angle position.

Another device for determining roll angle is previously known by virtue of Swedish patent 465 794. In this case a permanent magnet is fitted in the launchable body, which, when the body is launched from the launching tube of the launcher, induces a field in windings fitted in the launching tube. The roll angle at the moment of launch is able to be determined through expedient signal processing. Information on this roll angle and the time which has elapsed since the launch is fed via a communications link to the launchable body which, with the aid of integrated electronics, calculates from this the rotation position in question. Assuming that the rotational velocity of the launchable body is able to be predicted or determined with high accuracy throughout the flight course of the body up to a possible point of correction, the known device offers the chance to calculate the rotation position with an accuracy which in normal cases is acceptable. If, however, the rotational velocity which is applied in calculating a roll angle position deviates from the correct rotational velocity, then the error in the roll angle position, especially when a long time has elapsed since the launch, will be unacceptable.

One object of the present invention is to achieve a process and a device which offer great accuracy without consequently entailing great complexity. Another object is to achieve simple communication between launcher and the launchable body.

SUMMARY OF THE INVENTION

The objects of the invention are achieved through a process characterized in that, for determination of the roll angle, communication is established between the launcher and the launchable body during the travel of the launchable body by the transmission of a polarized carrier wave in connection with the launcher and in that the transmitted polarized carrier wave is detected in the launchable body with regard to rotation dependency, and a device characterized in that a transmitter is arranged in connection with the launcher for communication with the launchable body by the transmission of a polarized carrier wave and in that the launchable body comprises a polarization-direction-sensitive receiver, the polarization-direction-sensitivity of which is arranged to track the rotation of the launchable body.

By housing the magnetic-field-detecting members in the launchable body, the launchable body is able independently to keep track of its roll angle on the basis of angular position at the moment of launch and counting of minima in a carrier-wave signal.

According to an advantageous process, the roll angle of the launchable body at the moment of launch is determined in the launchable body on the basis of the induced field or fields, minima are detected and counted in the transmitted polarized carrier wave from the point of launch and a time measurement is started at the moment of launch. By keeping track of minima and coupling these to the roll angle of the launchable body as it leaves the launcher, a simple solution is obtained to the problem of unambiguity in differentiating between 0 and $\pi$ radians.

According to a further advantageous process based on previous processes, for first detected minima it is established, starting from the roll angle determined at the moment of launch, whether the minimum corresponds to 0 or $\pi$ radians based on the field or fields induced at the moment of launch.

A specific angle of rotation $\alpha$ for the launchable body following the point in time $t_{zero(n+1)}$ is identified as the time t, in which $$t=\alpha/360\cdot T,$$

$$2\cdot\Delta t=T,$$

$$\Delta t=t_{zero(n+1)}-t_{zero(n)}$$

and $t_{zero(n)}$ represents the point in time following the launch moment when the nth. minimum in the polarized carrier wave is detected.

Advantageously, the magnetic-field-generating members are constituted by a first and a second permanent magnet arranged on the launching tube and mutually rotated 90 degrees relative to the axis of symmetry of the launching tube in order each to generate a magnetic field in respectively a first and second radial direction through the tube, which directions are rotated 90 degrees.

In order to detect the generated magnetic field, the launchable body is advantageously provided with magnetic-field-detecting members comprising a coil and a first and a second sample and holding circuit, the output signal levels of which are fed to a processor.

Advantageously, the launchable body comprises further minima-detecting means in the signal which the launchable body receives from the transmitter arranged in connection with the launcher and means for counting detected minima.

According to an advantageous embodiment, the minima-detecting means comprises a phase detector and a processor. The means for counting detected minima is expediently constituted by a processor.

According to another advantageous embodiment, the launchable body in the device according to the invention comprises time-measuring means. In a device according to the invention in which the launchable body is provided with one or more control charges, the time-measuring means herein defines the simultaneous triggering time of one or more control charges on the basis of transmitted angle information a and detected minima.

BRIEF DESCRIPTION OF THE DRAWINGS

The invention will be described in greater detail below by means of an illustrative embodiment with reference to appended drawings, in which:

FIG. 6 shows a phase shift detected in the transmitted signal. FIG. 6 shows an example of the resultant signal strength in a receiver.

DETAILED DESCRIPTION OF THE INVENTION

Figure 1:
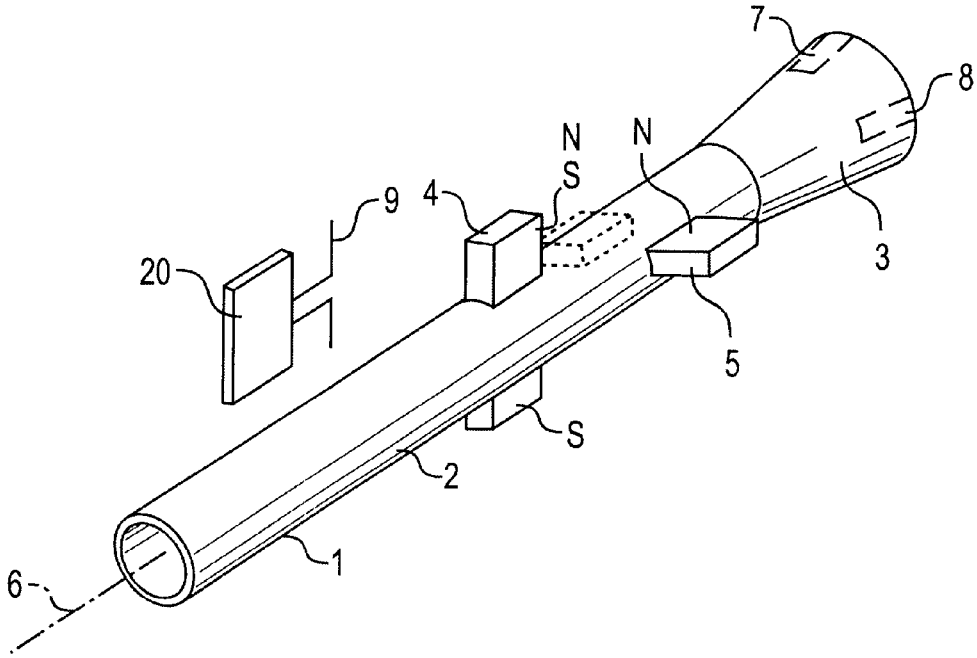
FIG. 1 shows parts of a launcher in which the invention can be applied.

The launcher 1 which is partially shown in FIG. 1 comprises a launching tube or firing tube 2 having a conical mouth 3. To the firing tube there are fitted two permanent magnets 4 and 5 to generate inducing fields perpendicular to the axis or symmetry 6 of the firing tube inside the firing tube. The permanent magnets are mutually rotated 90 degrees. An alternative placement of the permanent magnets has been indicated by means of dashed lines 7, 8 in the mouth 3 of the firing tube. Connected to the launcher 1, a transmitter 20 is also connected to an antenna 9 for transmission of a polarized carrier-wave signal.

Figure 2:
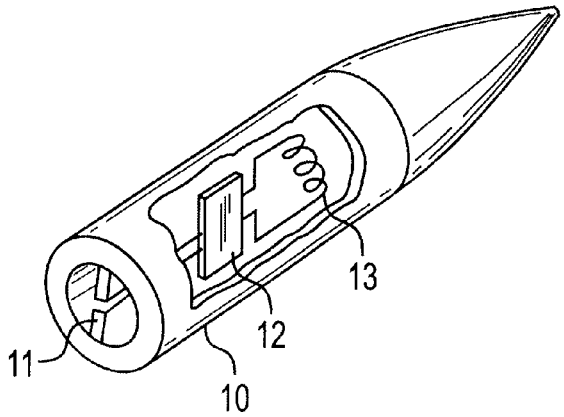
FIG. 2 shows a launchable body having magnetic-field-detecting members and forming part of the invention.
Figure 3:
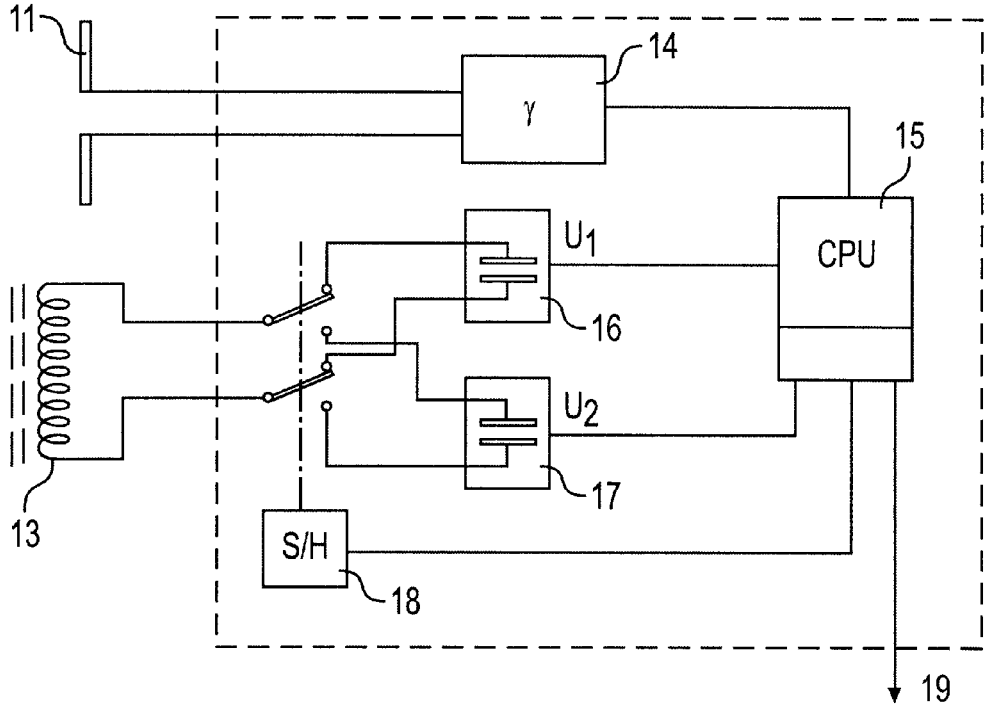
FIG. 3 shows an example of an electronic part intended to form part of the launchable body.

FIG. 2 shows a launchable body 10 in the form of a shell or the like intended to be housed, in the starting position, in the firing tube 2 of the launcher. In the rear part of the launchable body there is a microwave antenna 11 intended to receive the signal transmitted by the antenna 9. The microwave antenna 11 is coupled to an electronics block 12 which will be described in greater detail with reference to FIG. 3. The body 10 further houses a coil 13, a so-called pick-up coil, directed to detect radially induced fields. The coil 13 is likewise coupled to the electronics block 12.

Forming part of the electronics block 12 is a phase detector 14, the input of which is connected to the microwave antenna 11 and the output of which is coupled to a processor 15. The electronics block further contains a first and a second holding circuit 16, 17 directed at the inputs of a common sample circuit 18. The output signals of the holding circuits are fed to the processor 15, which processor has a control order output 19.

Figure 4:
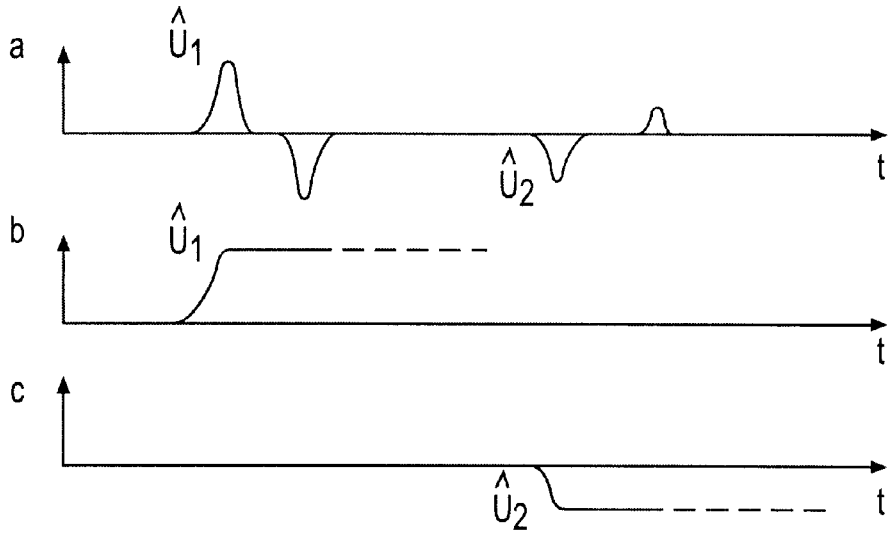
FIGS. 4*a,* 4*b,* 4*c* show examples of voltages which occur in various parts of the electronic part according to the invention.
Figure 5:
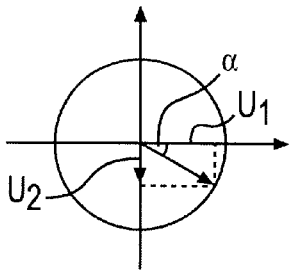
FIG. 5 illustrates the relationship between the direction of a coil forming part of the magnetic-field-detecting members and induced voltage pulses.

A launch procedure can proceed as follows. When the body or the shell 10 passes the magnets 4 and 5 following the firing, voltage pulses $u_1$ and $u_2$ are induced according to FIG. 4*a,* which shows induced voltage as a function of time t. The peak values of the voltages are herein denoted by $\hat{u}_1$ and $\hat{u}_2$ respectively. The holding circuits 16 and 17 shown in FIG. 3 store the induced voltages, FIG. 4*b* showing the voltage stored in the holding circuit 16 and FIG. 4*c* showing the voltage stored in the holding circuit 17. FIG. 5 illustrates the relationship between the orientation of the coil in the shell and the induced voltages $u_1$ and $u_2$.

The output angle $\alpha_0$ is calculated in the processor 15 on the basis of the relationship:

$$\alpha_0 = \arctan \hat{u}_2/\hat{u}_1.$$

Figure 6:
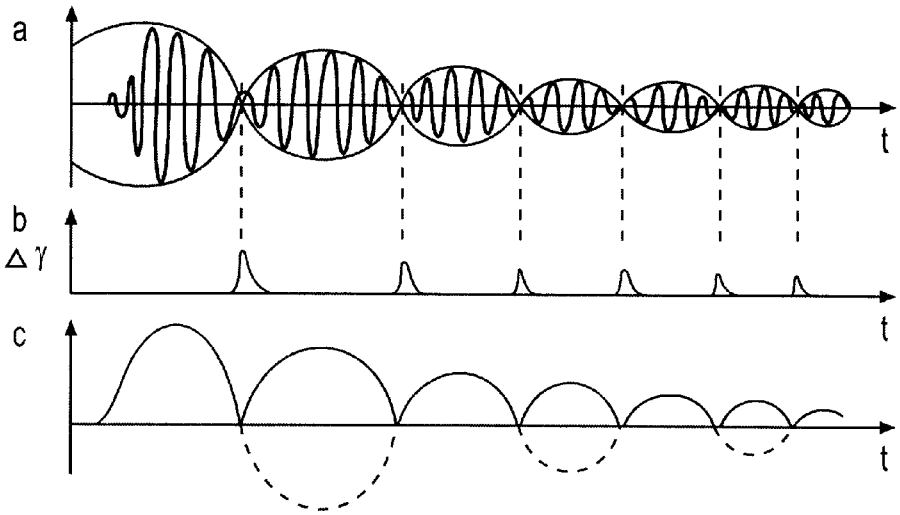
FIG. 6 shows an example of a signal transmitted by the transmitter.
Figure 7:
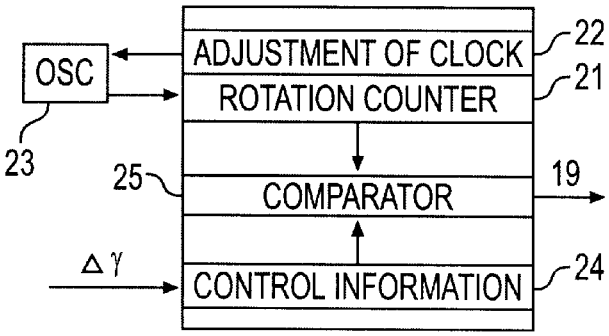
FIG. 7 shows the working method for a processor forming part of the electronic part according to FIG. 3 for execution of a control signal.

During the launching procedure, the transmitter 20 according to the shown embodiment sends out an E-field-polarized carrier wave, for example having vertical polarization. The signal received in the shell 10 by the microwave antenna 11 is shown in FIG. 6. The received signal is fed to a phase detector 14, the output signal of which in principle indicates minima in the received signal. An imaginary rectified carrier wave should have the appearance as shown in FIG. 6 and can be mathematically notated as $u=|\hat{u}\cdot\sin \omega_{rot}\cdot t|$, in which $\omega_{rot}$ relates to the rotation of the shell. This gives an ambiguity as to whether first minima correspond to 0 or $\pi$ radians. With the aid of the output angle ao calculated according to the above, the processor 15 determines whether first minima correspond to 0 or $\pi$ radians. With the aid of the input signal from the phase detector 14, the processor 15 measures the time for the rotation of the shell and adjusts the clock interval of a rotation counter 21. In the processor 15 there is shown in diagrammatic representation a block 22, which, in cooperation with an oscillator 23, handles the adjustment of the rotation counter 21. A control command which is sent, for example, by a frequency shift of the carrier wave of the signal transmitted by the transmitter 20 and is handled by a control information block 24 is converted into an equivalent time value of the rotation and is stored in a digital comparator 25. When the time value of the rotation counter reaches the time value stored in the comparator, a control signal is emitted at the control order output 19 of the processor 15 so as to trigger one or more control charges fitted in the shell, which charges, when activated, correct the course of the shell. The size of the course correction can be affected by choice of the number of control charges which are simultaneously activated. A single triggered charge normally gives less course correction than if two adjoining control charges are triggered simultaneously.

If the zero passages of the received signal are denoted as $t_{zero(n)}$, in which n corresponds to the nth. zero passage, the time between the nth. and (n+1)th. zero passages can be notated as $\Delta t = t_{zero(n+1)} - t_{zero(n)}$ and the period $T = 2\cdot\Delta t$. The time which corresponds to $\alpha$ can then be expressed as $t = \alpha/360\cdot T$.

What is claimed is:

1. A process for determining roll angle of a body launchable from a launcher, the process comprising:

inducing at least one inducing field in the launchable body;

transmitting a polarized carrier wave from the launcher to the launchable body;

detecting the transmitted polarized carrier wave in the launchable body with respect to rotation of the launchable body; and analyzing the detected transmitted polarized carrier wave and the inducing field to establish the roll angle as the launchable body leaves the launcher, wherein the roll angle of the launchable body at the moment of launch is determined in the launchable body on the basis of the induced field or fields, in that minima are detected and counted in the transmitted polarized carrier wave from the point of launch and in that a time measurement is started at the moment of launch, and wherein for a first detected minima it is established, starting from the roll angle determined at the moment of launch, whether the minimum corresponds to 0 or $\pi$ radians based on the field or fields induced at the moment of launch.

2. A process for determining roll angle of a body launchable from a launcher, the process comprising:

inducing at least one inducing field in the launchable body;

transmitting a polarized carrier wave from the launcher to the launchable body;

detecting the transmitted polarized carrier wave in the launchable body with respect to rotation of the launchable body; and analyzing the detected transmitted polarized carrier wave and the inducing field to establish the roll angle as the launchable body leaves the launcher, wherein the roll angle of the launchable body at the moment of launch is determined in the launchable body on the basis of the induced field or fields, in that minima are detected and counted in the transmitted polarized carrier wave from the point of launch and in that a time measurement is started at the moment of launch and wherein the angle of rotation $\alpha$ for the launchable body following the point in time $t_{zero(n+1)}$ is identified as the time t, where $$t=\alpha/360\cdot T,$$

$$2\cdot\Delta t=T,$$

$$\Delta t=t_{zero(n+1)}-t_{zero(n)}$$

and $t_{zero(n)}$ represents the point in time following the launch moment when the nth. minimum in the polarized carrier wave is detected.

* * * * *